United States Patent [19]

Naujock

[11] Patent Number: 4,979,254

[45] Date of Patent: Dec. 25, 1990

[54] ERASER FEEDER

[76] Inventor: Gordon L. Naujock, 3642 Norport Rd., Port Washington, Wis. 53074

[21] Appl. No.: 492,076

[22] Filed: Mar. 12, 1990

[51] Int. Cl.[5] ..... B43L 19/00; B43K 29/02

[52] U.S. Cl. ..... 15/3.53; 15/3.53; 15/424; 15/428; 15/429; 15/433; 15/434

[58] Field of Search ..... 15/424, 428, 429, 430, 15/433, 434, 3.53, 105.51

[56] References Cited

U.S. PATENT DOCUMENTS 2,261,314 11/1941 Vogel ..... 15/434

2,417,925 3/1947 Gerster-Seiler ..... 15/429

FOREIGN PATENT DOCUMENTS 343843 2/1960 Switzerland ..... 15/3.53

295472 8/1928 United Kingdom ..... 15/430

*Primary Examiner*—Paul T. Sewell

*Assistant Examiner*—M. D. Patterson

[57] ABSTRACT

An eraser mover for use with a power eraser comprising mechanical means for sliding the eraser out of its holder by inserting prongs into the eraser and moving the prongs outwardly.

4 Claims, 1 Drawing Sheet

ERASER FEEDER

BACKGROUND OF THE INVENTION

This invention relates to an improvement in power erasers. Conventionally, cylindrically shaped erasers are held with a collet having a plurality of longitudinal slots. The outer end of the collet is flared to retain a collar and the outer surface of the collet is tapered slightly thereby forming a frustum of a cone with the base of the cone toward the outer end of the collet. Movement of a collar, which surrounds the collet, toward the outer end of the collet causes an eraser placed within the collet to be squeezed and held in place for use. These conventional features are shown in FIG. 1.

The above described apparatus is satisfactory except for an annoying problem which occurs from time to time as the power eraser is used. Occasionally, the operator will allow the eraser to become worn to the point where it cannot be conveniently gripped with the fingers and additional eraser material extracted for continued use. At this time, the user is reduced to poking a pointed instrument, such as a pair of dividers into one of the slots and forcing more eraser material out of the collet. The invention described herein is a feeding mechanism which solves this problem by adding means for sliding the eraser outwardly by inserting prongs into the eraser and moving the prongs outwardly.

Several species of the means for sliding the eraser outwardly are shown in the accompaning drawings and will be discussed in detail in the following material.

The problem of feeding the eraser when it is worn down to the collet has been recognized before. The solutions shown in the following patents all address the problem, however, this invention is unique in that it provides a feeder mechanism of simple construction. Furthermore, this invention can be retrofitted onto the conventional power erasers in use today. See:

Motor Driven Adjustable Eraser, C. Sturzenegger, U.S. Pat. No. 2,487,903

Eraser Control Apparatus, N. L. Stokes, U.S. Pat. No. 3,427,677

Eraser Molding Chuck and Eraser, L. J. Misuraca, U.S. Pat. No. 3,224,417

DESCRIPTION OF THE PREFERRED EMBODIMENT

Figure 1:
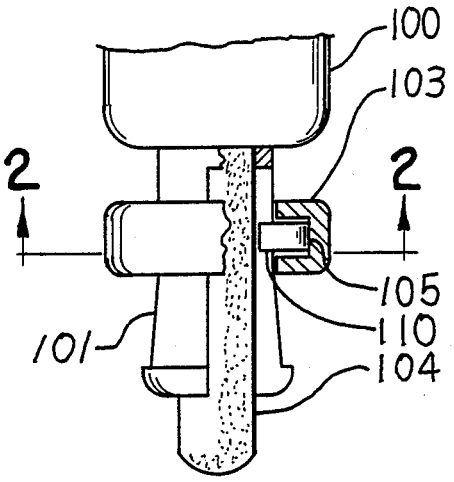
FIG. 1 shows a side view of a first embodiment of the invention.
Figure 2:
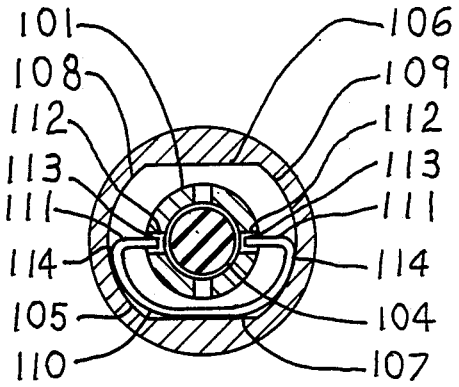
FIG. 2 is a cross-sectional view of the first embodiment of the invention showing the arrangement of elements when the eraser is disengaged.
Figure 3:
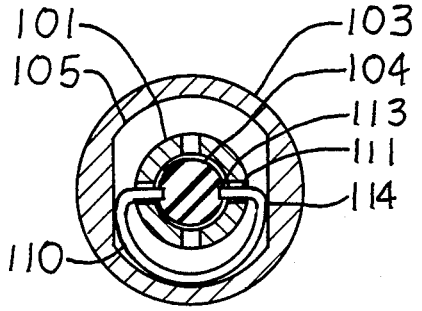
FIG. 3 is also a cross-sectional view of the first embodiment of this invention showing the arrangement of elements when the eraser is engaged.

With reference to FIG. 1 through 3, power eraser 100 and collet 101 are of conventional design. Collar 103, which slidably interacts with the exterior of collet 101 in a conventional manner to provide means for squeezing eraser 104, also has a groven 105 in its inner surface. Although groove 105 may take many shapes, it must have at least one portion which is radially less distant from the center of collar 103 than the remainder of groove 105. For example, groove 105 may be hexagonal shape or may be square. In the preferred embodiment, best shown in FIG. 2, it comprises parallel flat grooves 106 and 107 which are joined on each end by annular grooves 108 and 109. Clip 110, which is located within groove 105 and which may be made of any material having springlike characteristics, has at least one leg which extends into a longitudinal slot 112 in collet 101. In the preferred embodiment, clip 110 is "D" shaped and has a pair of legs 111 which extend into longitudinal slots 112 in collet 101. The outer ends 113 of legs 111 are in juxtaposition with eraser 104, but do not touch it when the feeding mechanism is not in use. In this position, the inner ends 114 of legs 111 are in the annular portions of groove 105. If collar 103 is rotated 90 degrees, as shown in FIG. 3, the flat parallel portions of groove 105 contact inner ends 114 of legs 111 and urge outer ends 113 of legs 111 against eraser 104. After engagement of eraser 104 by legs 111, longitudinal movement of collar 103 produces a corresponding movement of eraser 104. Rotation of collar 103 another 90 degrees allows legs 111 to retract and disengage eraser 104.

Figure 4:
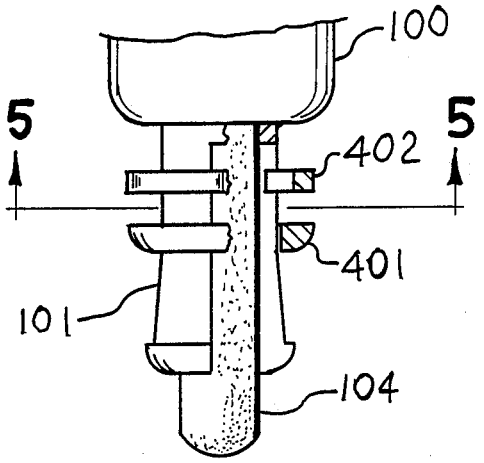
FIG. 4 shows a side view of a second embodiment of the invention.
Figure 5:
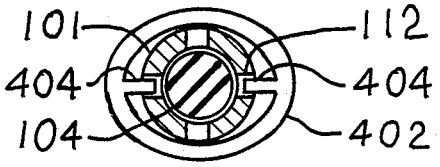
FIG. 5 is a cross-sectional view of the second embodiment of the invention.

Another form of this invention (shown in FIGS. 4 and 5) comprises a conventional power eraser including a conventional collar 401 for squeezing the eraser plus addition collar 402 which also surrounds collet 101. Collet 402 is generally elliptical in shape in its relaxed position and may be made of any suitable flexible material. Legs 404 which protrude from the inner surface of collar 402 are located along the long axis of the ellipse and extend into longitudinal slots 112 in collet 101. As shown in FIG. 5, legs 404 do not engage eraser 104 when collar 402 is in the relaxed state. However, application of force on the collar at points adjacent to legs 404 will compress collar 402 and cause legs 404 to engage eraser 104. Longitudinal movement of collar 402, after engagement of legs 404, will cause corresponding movement of eraser 104.

Figure 6:
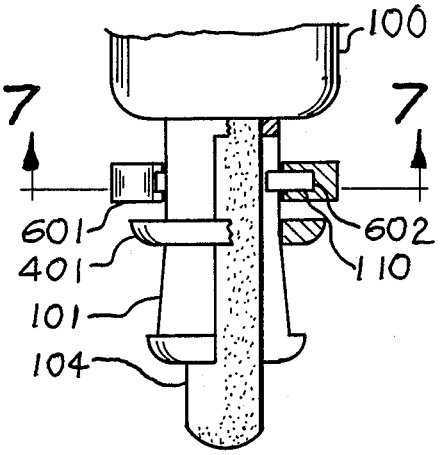
FIG. 6 is a side view of a third embodiment of the invention.
Figure 7:
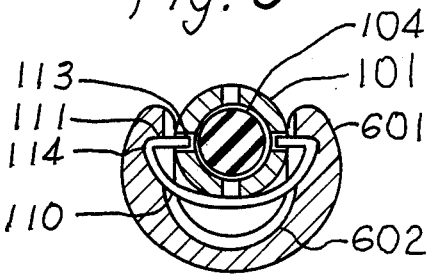
FIG. 7 is a cross-sectional view of the third embodiment of the invention.

A third embodiment of this invention is shown in FIGS. 6 and 7. Collar 601 is shown in this specific embodiment as being generally "U" shaped, however, it could take any functionally equivalent form. Collar 601 has an internal groove 602 into which "D" shaped clip 110 is inserted. Groove 602 follows the contour of the inner surface of collar 601 except at the ends of the "U" where the depth of the void is increased sufficiently to allow the outer ends 113 of legs 111 of "D" shaped clip 110 to disengage eraser 104 when inner ends 114 of legs 111 are in the deep portions of the voids. This position is shown in FIG. 7. Movement of collar 601 transversely causes clip 110 to be compressed and legs 111 to engage eraser 104. Longitudinal movement of collar 601 after engagement of eraser 104 by legs 111 will cause corresponding movement of eraser 104.

Other variations of this invention including reversal of the spring action so that a cam action is used to retract the prongs is within the contemplation of this invention.

What is claimed is:

1. An improvement in power erasers of the type having means for rotating an eraser, the eraser being held in a collet having a plurality of longitudinal slots, and a collar which surrounds the collet, the longitudinal movement of which causes the engagement or disengagement of an eraser placed within the collet which further comprises mechanical means for sliding the eraser placed in the collet outwardly "including at least one prong, means for inserting said prongs" into the eraser "responsive to movement of the mechanical means and means for" moving the prongs outwardly.

2. The power eraser as claimed in claim 1 wherein the means for sliding the eraser placed in the collet outwardly by inserting prongs into the eraser and moving the prongs outwardly comprises:

a. a circular collar surrounding the collet having a groove in its inner surface, said groove having at least one portion which is radially less distant from the center of the collar than the remainder of the groove; and b. a "D" shaped clip located within the groove, the flat portion of the "D" being broken to form legs which extend into the longitudinal slots in the collet, said legs moving transversly to the collet in response to rotation of said collar whereby an eraser placed within the collet may be gripped by the legs when the narrow portion of the oblong groove is adjacent to the legs.

3. The power eraser as claimed in claim 1 wherein the means for sliding the eraser placed in the collet outwardly by insertion of prongs into the eraser and moving the prongs outwardly comprises: a collar made of any suitable flexible material having a generally elliptical shape when in its relaxed state, legs located along the long axix of the ellipse which protrude from the inner surface of the collar, said legs extending into the longitudinal slots in the collet and moving transversly to the collet in response to compression of the collar along its long axis whereby an eraser placed within the collet may be gripped by the legs.

4. The power eraser as claimed in claim 1 wherein the means for sliding the eraser placed in the collet outwardly by insertion of prongs into the eraser and moving the prongs outwardly comprises:

a. a "D" shaped clip made of springlike material, the flat portion of the "D" being broken to form legs which extend into the longitudinal slots in the collet, the legs being engagable with an eraser held within the collet; and b. a "U" shaped collar, having an internal groove into which the "D" shaped clip is inserted, said groove following the contour of the inner surface of the collar except at the ends of the "U" where the depth of the groove is increased sufficiently to allow the outer ends of the legs of the clip to disengage an eraser placed within the collet in response to transverse movement of the collar away from the collet.

* * * * *